US007766604B2

(12) United States Patent
Honda et al.

(10) Patent No.: US 7,766,604 B2
(45) Date of Patent: Aug. 3, 2010

(54) FUEL PUMP

(75) Inventors: Yoshihiko Honda, Obu (JP); Sumito Takeda, Obu (JP); Shinichi Fujii, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 931 days.

(21) Appl. No.: 11/400,193

(22) Filed: Apr. 10, 2006

(65) Prior Publication Data

US 2007/0031239 A1 Feb. 8, 2007

(30) Foreign Application Priority Data

Aug. 4, 2005 (JP) ..... 2005-112302

(51) Int. Cl.
*F03B 11/04* (2006.01)
*F04D 29/66* (2006.01)

(52) U.S. Cl. ..... 415/55.4; 415/55.1; 415/119

(58) Field of Classification Search ..... 415/55.1–55.7, 415/119

See application file for complete search history.

(56) References Cited

U.S. PATENT DOCUMENTS 5,011,367 A * 4/1991 Yoshida et al. ..... 415/55.1
5,464,319 A * 11/1995 Liskow ..... 415/55.1
5,498,124 A 3/1996 Ito et al.
5,716,191 A 2/1998 Ito et al.
5,772,393 A * 6/1998 Nakamura et al. ..... 415/55.4
6,152,687 A * 11/2000 Wilhelm et al. ..... 415/55.1
6,336,788 B1 1/2002 Fujii et al.
6,527,505 B2 * 3/2003 Yu et al. ..... 415/55.1
7,244,094 B2 * 7/2007 Miura et al. ..... 415/55.4

FOREIGN PATENT DOCUMENTS

DE 4446537 6/1996
DE 10024741 1/2001
EP 1158172 11/2001

* cited by examiner

*Primary Examiner*—Edward Look
*Assistant Examiner*—Sean J Younger
(74) *Attorney, Agent, or Firm*—Dennison, Schultz & MacDonald

(57) ABSTRACT

Fuel pump (10)comprises a casing (18) and an impeller (20). A group of concavities (20*a*) are formed in an upper or a lower face of the impeller. A groove (24) communicating a discharge hole (25) is formed in a inner face of the casing. The groove has an opening portion (27*e*) that directly communicates with the discharge hole. The opening portion is shaped so as to extend in the rotation direction of the impeller, within a span extending from a position corresponding to substantially the central position of the concavities of the impeller, in the radial direction thereof, to a position corresponding to substantially the outer peripheral edge of the concavities of the impeller. The opening portion is be formed so as to extend in the rotation direction of the impeller beyond the position (29*b*) where the inner peripheral edge connects therewith.

7 Claims, 15 Drawing Sheets

FUEL PUMP

CROSS REFERENCE

This application claims priority to Japanese Patent application number 2005-112302, filed on Apr. 8, 2005, the contents of which are hereby incorporated by reference as if fully set forth herein.

BACKGROUND OF THE INVENTION

1. Field of the Invention

The present invention relates to a fuel pump for drawing in a fuel such as gasoline etc., increasing the pressure thereof, and discharging the pressurized fuel.

2. Description of the Related Art

A known fuel pump generally comprises a substantially disc-shaped impeller and a casing. The impeller is rotatably disposed within the casing. A group of concavities is formed in an upper face of the impeller, and another group of concavities is formed in a lower face of the impeller. The concavities are repeated in a circumferential direction. Adjacent concavities are separated by partition walls that extend in a radial direction. A first groove is formed in a front surface of the casing in an area directly facing the group of concavities in the upper face of the impeller. The first groove extends continuously in a circumference direction from an upstream end to a downstream end. A second groove is formed in a back surface of the casing in an area directly facing the group of concavities in the lower face of the impeller. The second groove extends continuously in a circumference direction from an upstream end to a downstream end. An intake hole and a discharge hole is formed in the casing. The upstream end of the first groove communicates with the outside of the casing via the intake hole. The downstream end of the second groove communicates with the outside of the casing via the discharge hole.

When the impeller rotates, the fuel pump draws fuel into the casing from the intake hole. The drawn fuel flows along the grooves and the concavities of the impeller. Swirl flow occurs between the concavities on the front face of the impeller and the first groove, and between the concavities on the back face of the impeller and the second groove as a result of centrifugal forces caused by the rotation of the impeller. The fuel drawn into the casing flows to the downstream side along the first groove and second groove while creating swirl flow. The fuel is pressurized and the pressurized fuel is discharged out of the casing through the discharge hole.

In the above described fuel pump, the fuel drawn into the casing flows along the first groove and the second groove, and flows from the downstream end of the second groove to the discharge hole. The fuel in the front face (i.e.., downstream side face) of the partition walls of the impeller has nowhere to go when the partition walls of the impeller pass by the downstream end of the second groove (discharge hole), which causes a drastic increase in fuel pressure. As a result of this pressure increase is generated noise of a frequency corresponding to the number of partition walls and to the number of rotations of the impeller.

Japanese Laid-open Patent Publication No. 6-228831 discloses fuel pump in which buffering portion for dampening the rise in fuel pressure are formed in the downstream end of the second groove. This fuel pump has a circular discharge hole provided in the vicinity of the downstream end of a second groove, and buffering groove (i.e.., buffering portion) extending beyond the discharge hole in the rotation direction of the impeller. In this fuel pump, when the partition wall of the impeller pass by the downstream end of the second groove (discharge hole), part of the fuel in the front face of the partition wall can flow to the discharge hole via the buffering groove. As a result, the rise in fuel pressure is dampened, which should result in noise reduction.

In the conventional fuel pumps described above, however, the fuel flowing from the buffering groove towards the discharge hole collides with the fuel flowing from the second groove towards the discharge hole. This hampers the flow of the fuel from the buffering groove towards the discharge hole, which in turn precludes achieving sufficient dampening of the rise in fuel pressure on the front face of the partition walls of the impeller.

In the above conventional fuel pumps, in particular, the discharge hole is shaped with a circular form having a diameter substantially identical to the width of the concavities of the impeller (i.e.., length of the partition walls); as a result, the fuel flowing in the second groove hits against the downstream end of the second groove with substantially identical timing. Fuel flow from the buffering groove towards the discharge hole becomes thereby greatly hindered, which precludes achieving sufficient dampening of the rise in fuel pressure.

SUMMARY OF THE INVENTION

Accordingly, it is one object of the present teachings to provide a fuel pump that allows sufficiently curbing periodic fuel pressure increases caused by rotation of the impeller, thereby reducing impeller noise.

In one aspect of the present teachings, a fuel pump may comprise a casing and an impeller rotating within the casing. A group of concavities may be formed in an upper or a lower face of the impeller. The concavities forming the group may be repeated in a circumference direction of the impeller. A groove communicating a discharge hole may be formed in a inner face of the casing. The groove extends continuously in a direction of rotation of the impeller in an area facing the group of concavities of the impeller.

The groove may have an opening portion that directly communicates with the discharge hole. The opening portion may be shaped so as to extend in the rotation direction of the impeller, within a span extending from a position corresponding to substantially the central position of the concavities of the impeller, in the radial direction thereof, to a position corresponding to substantially the outer peripheral edge of the concavities of the impeller. The inner peripheral edge of the groove, on the side communicating with the discharge hole, may slant in the downstream end from a position corresponding to substantially the inner peripheral edge of the concavities of the impeller towards a position corresponding to substantially the central position of the concavities of the impeller, in the radial direction thereof, to connect with the opening portion. The opening portion may be formed so as to extend in the rotation direction of the impeller beyond the position where the inner peripheral edge connects therewith.

In this fuel pump, the opening portion of the groove is formed from a position corresponding to substantially the central position of the concavities of the impeller, in the radial direction thereof, up to the outer side, while the inner peripheral edge of the groove slants towards the opening portion to connect therewith. As a result, the fuel flowing along the groove collides successively from the inner perimeter against the downstream end of the groove. The fuel flowing along the groove does not collide therefore with substantially identical timing against the downstream end of the groove, curbing thereby fuel pressure rises. The opening portion of the groove extends in the rotation direction of the impeller beyond a position in which the inner peripheral edge of the groove connects with the opening portion thereof, which has the effect of prolonging the time during which partition walls of the impeller pass over the opening. The fuel, as a result, flows easily through the opening portion into the discharge hole, which curbs rises in fuel pressure in the concavities of the impeller (i.e.., front faces of the partition walls). Periodic rises in fuel pressure, brought about by the rotation of the impeller, are thus effectively curbed in such a fuel pump, making it possible to reduce fuel pump noise.

Herein, the groove may be formed on both the front and rear faces of the impeller, or on only one among the front and rear faces of the impeller. When grooves are formed on both the front and rear faces of the impeller, one of them may connect with the intake hole, while the other may connect with the discharge hole. Alternatively, when grooves are formed on both faces of the impeller, the upstream end thereof may connect with the intake hole while the downstream thereof may connect with the discharge hole. When the groove is formed on only one among the front and rear faces of the impeller, the upstream end thereof connects with the intake hole and the downstream thereof connects with the discharge hole.

In another aspect of the present teachings, the opening portion may extend towards the downstream side past the position at which the inner peripheral edge connects with the opening portion. In this case, the opening portion preferably has a width substantially identical to a span extending from a position corresponding to substantially the central position of the concavities of the impeller, in the radial direction thereof, to a position corresponding to substantially the outer peripheral edge of the concavities of the impeller.

In this fuel pump, the fuel can flow more easily into the discharge hole since the opening portion, which has a width substantially half that of the concavities of the impeller, extends in the rotation direction of the impeller. Periodic fuel pressure rises brought about by the rotation of the impeller are thus curbed, making it possible to reduce fuel pump noise.

Preferably, the width of the opening portion in the downstream end side tapers gradually off towards the downstream side. Since the downstream end of the opening portion tapers gradually off, periodic fuel pressure rises brought about by the rotation of the impeller are thus dampened. This allows reducing fuel pump noise.

Herein, the width of the opening portion in the downstream end may taper off gradually from the inner perimeter of the opening portion towards the outer perimeter thereof, or from the outer perimeter of the opening portion towards the inner perimeter thereof. Alternatively, the width of the opening portion in the downstream end may taper off gradually from both the inner and outer perimeter of the opening portion towards the middle thereof.

In another aspect of the present teachings, a buffering groove may be formed at the downstream end of the opening portion of the groove. The buffering groove may have a width that tapers gradually off towards the downstream side. Since the buffering groove is formed at the opening portion, the fuel flows more easily from the buffering portion to the opening portion, which allows curbing periodic rises in fuel pressure brought about by the rotation of the impeller.

The buffering groove is preferably formed within a span extending from a position corresponding to substantially the central position of the concavities of the impeller, in the radial direction thereof, to a position corresponding to substantially the outer peripheral edge of the concavities of the impeller.

In another aspect of the present teachings, the discharge hole may be formed more to the rotation direction of the impeller than the upstream end of the opening portion of the groove. This causes the fuel flowing along the groove to flow more easily into the discharge hole, which allows increasing the pumping efficiency of the fuel pump.

Further, the discharge hole is preferably formed so as to slant in the rotation direction of the impeller from the opening portion of the groove. This causes the fuel flowing along the groove to flow more easily into the discharge hole, which allows increasing the pumping efficiency of the fuel pump.

These aspects and features may be utilized singularly or, in combination, in order to make improved fuel pump. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

DETAILED DESCRIPTION OF THE INVENTION

Figure 1:
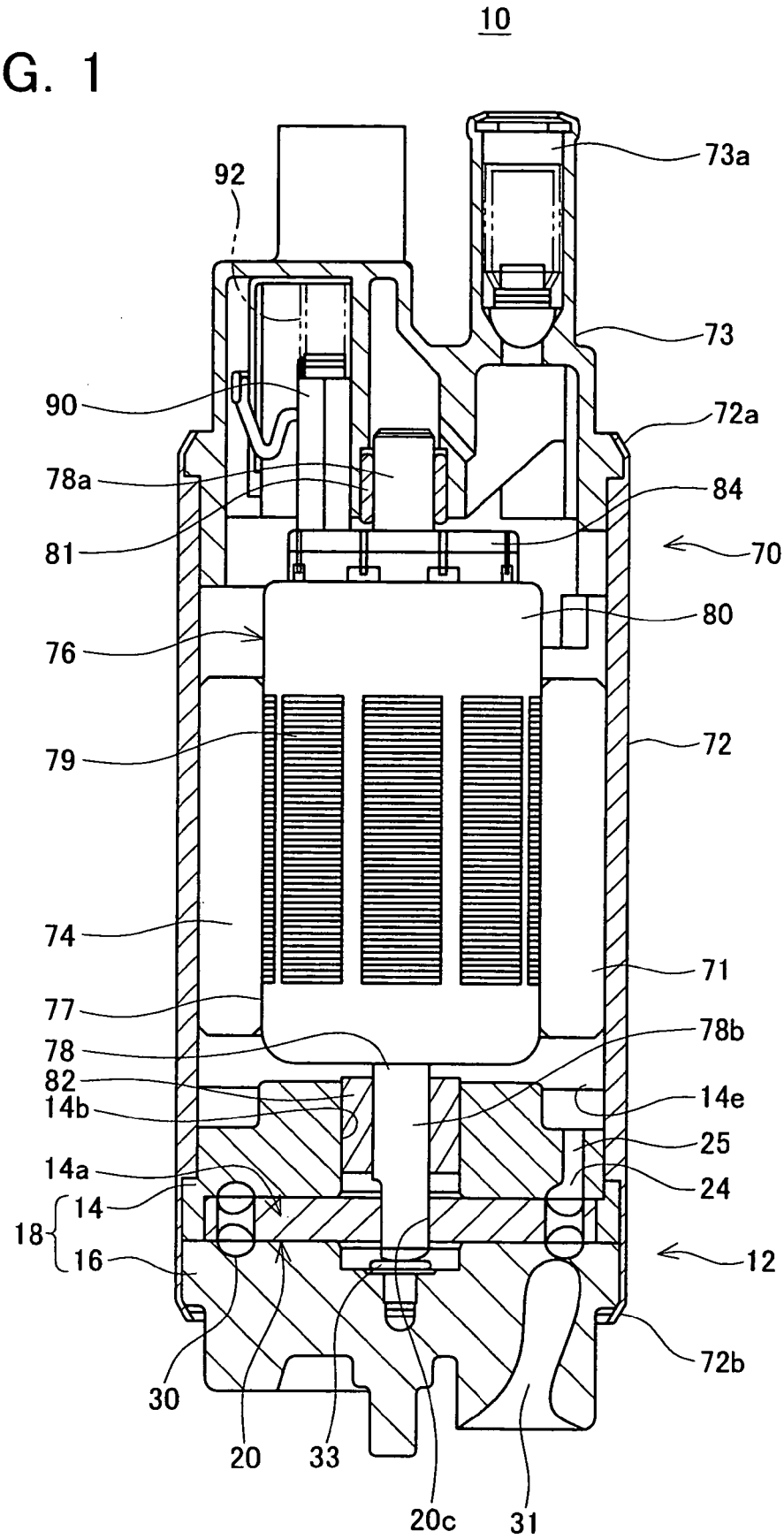
FIG. 1 shows a cross-sectional view of a fuel pump according to a first representative embodiment of the present teachings.

A fuel pump 10 according to a first representative embodiment of the present teachings will be described below. Fuel pump 10 may be used in an automobile, fuel pump 10 being utilized within a fuel tank and being utilized for supplying fuel to an engine of the automobile. As shown in FIG. 1, fuel pump 10 comprises a motor portion 70 and a pump portion 12.

The motor portion 70 comprises a housing 72, a motor cover 73, magnets 71, 74 and a rotor 76. The housing 72 has a substantial cylindrical form. The motor cover 73 is attached to the housing 72 by caulking the upper end 72*a* of the housing 72. A discharge port 73*a* is formed in the motor cover 73. The magnets 71, 74 are fastened to the inside wall of the housing 72.

The rotor 76 has a main body 77, a shaft 78, and a commutator 84. The shaft vertically passes through the main body 77. The main body 77 comprises a core 79 which is fastened to the shaft 78, a coil (not shown in the figures) which is wound around the core 79, and a plastic part 80 which fills in around the coil. The commutator 84 is disposed at the top end of the main body 77. A brush 90 is in contact with the upper surface of the commutator 84. The brush 90 is constantly pressed against the commutator with a spring 92 which is fastened on one end to the motor cover 73. When the brush 90 becomes worn out, the brush 90 will move downward depending on the degree of wear, so that the contact between the brush 90 and the commutator 84 will be maintained. The upper portion 78*a* of the shaft 78 is rotatably supported, via a bearing 81, which is provided on the motor cover 73. The lower portion 78*b* of the shaft 78 is rotatably supported, via a bearing 82, which is provided on a pump cover 14 attached to the lower end of the housing 71.

Figure 2:
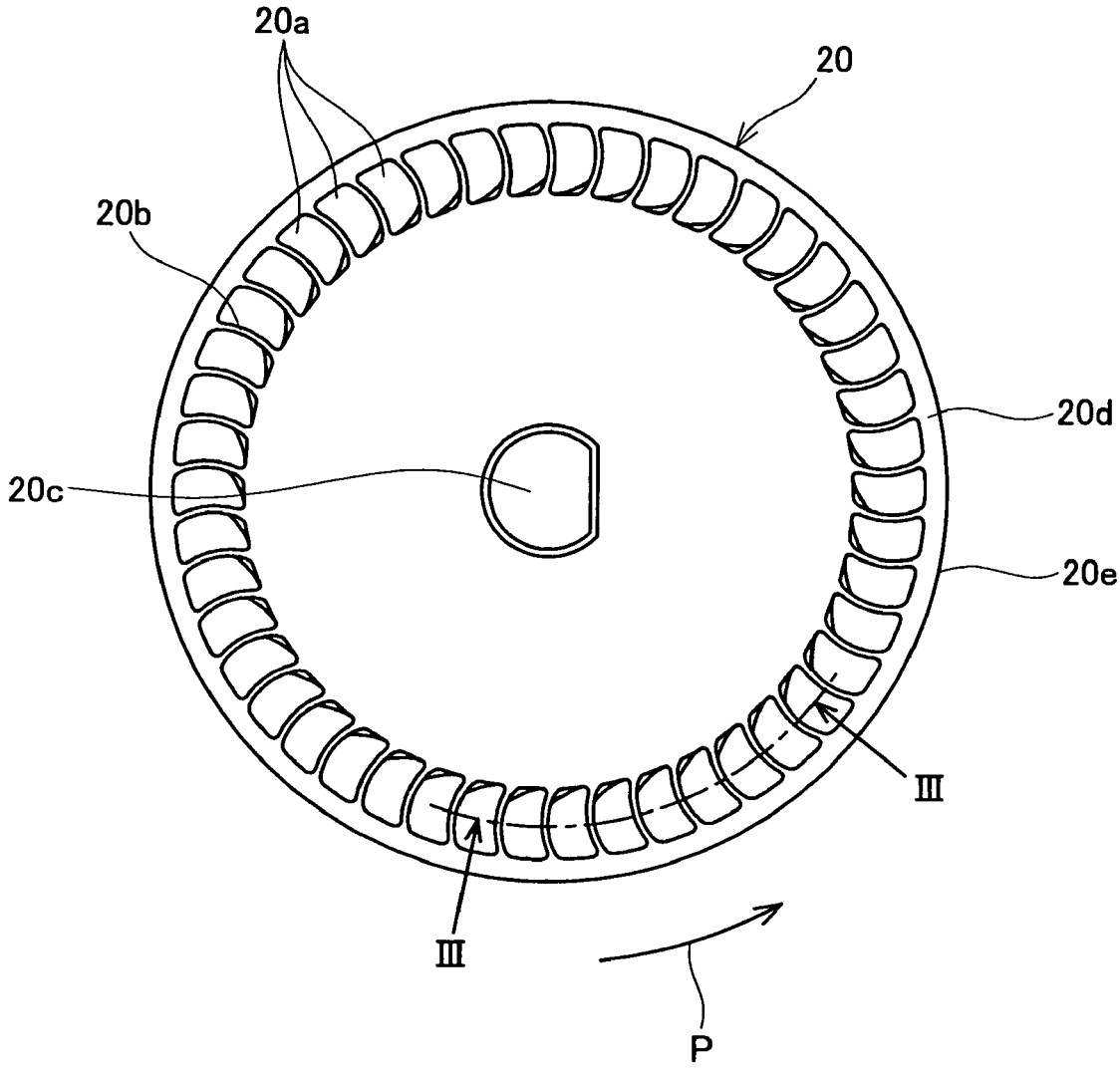
FIG. 2 shows a plan view of an impeller.

The pump portion 12 comprises a casing 18 and a substantially disc-shaped impeller 20. As shown in FIG. 2, a group of concavities 20*a* is formed in an area thereof inwards from an impeller outer circumference face 20*e* by a specified distance. The group of concavities 20*a* is formed along a circumference direction of the impeller 20. Adjacent concavities 20*a* are separated by partition walls 20*b* that extend in a radial direction. Concavities 20*a* and partition walls 20*b* form the group of concavities 10*a* that are repeated in a circumference direction. The group of concavities 20*a* is separated by an outer peripheral wall 20*d* of the impeller from the outer circumference face 20*e* of the impeller 20. The group of concavities 20*a* is formed in an upper face of the impeller 20. An approximately D-shaped fitting hole 20*c* is formed in the center of the impeller 20.

Figure 3:
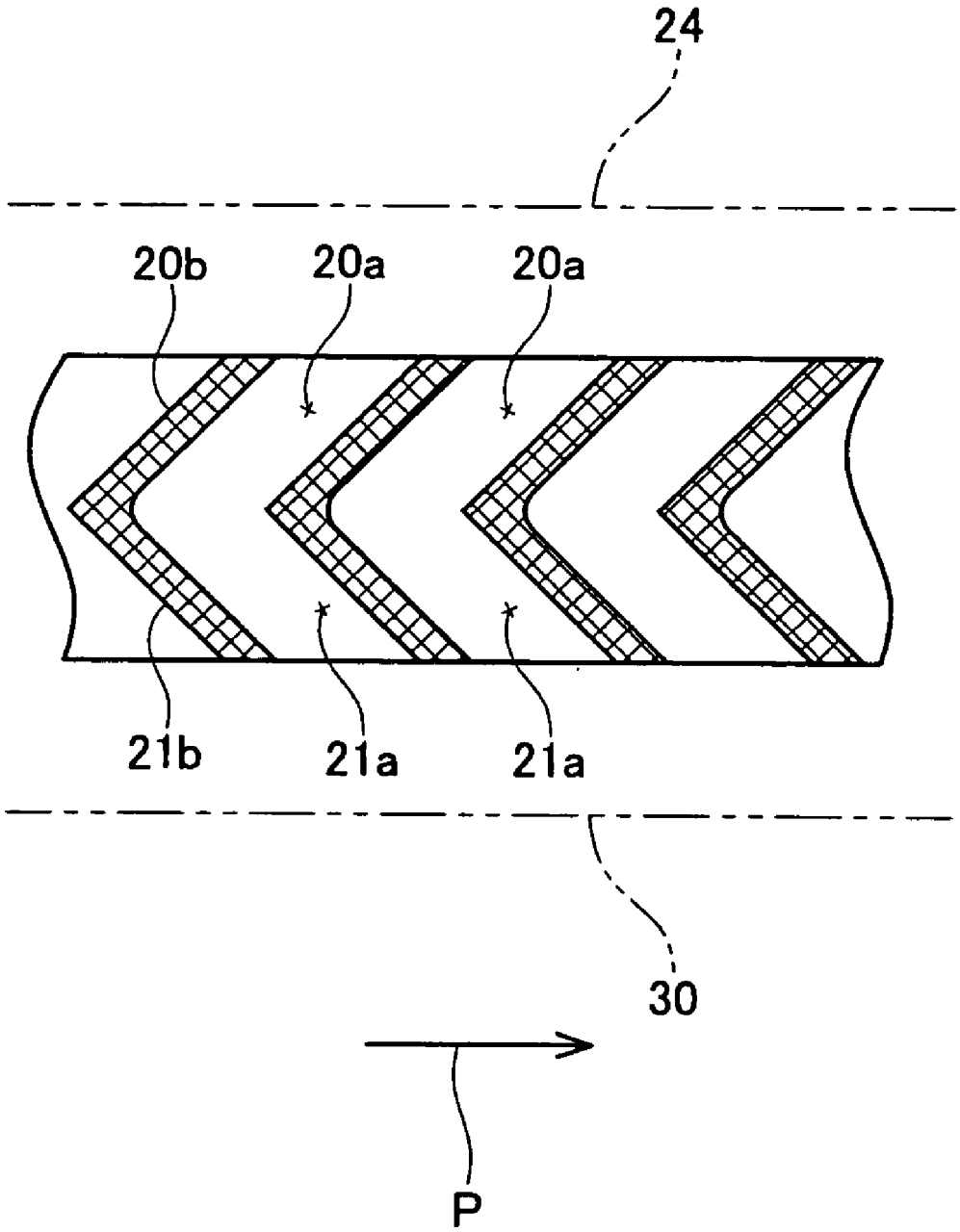
FIG. 3 shows a cross-sectional view along line III-III in FIG. 2.

As shown in FIG. 3, a group of concavities 21*a* is also formed in a lower face of the impeller 20. Adjacent concavities 21*a* are separated by partition walls 21*b*. The upper edge of the partition walls 21*b* are connected to the lower edge of the partition walls 20*b*. The partition walls 20*b* are angled to rise from the lower edge to the upper edge (i.e.., upper face of the impeller 20) in the direction that the impeller 20 rotates (direction of arrow P in FIGS. 2, 3). On the other hand, the partition walls 21*b* are angled down from the upper edge to the lower edge (i.e., lower face of the impeller 20) in the direction that the impeller 20 rotates. Therefore, substantially V-shaped partition walls are formed by partition walls 20*b* and partition walls 21*b*. Herein, the angle of inclination of the partition walls 20*b*, 21*b* is preferably adjusted within the range of 40~60° relative to the rotating axis of the impeller 20.

The casing 18 comprises a pump cover 14 and a pump body 16. As shown in FIG. 1, the surface of the pump cover 14 on the impeller side has a circular recess 14*a*. The diameter of the recess 14*a* is substantially the same as the diameter of the impeller 20. The recess 14*a* has a depth which is substantially as large as the thickness of the impeller 20. The impeller 20 is rotatably fitted into this recess 14*a*.

The casing 18 (i.e.., a pump cover 14 and pump body 16) is attached to the housing 72 by caulking the lower end 72*b* of the housing 72 with the impeller 20 fitted into the recess 14*a* of the pump cover 14. The lower portion 78*b* of the shaft 78 fits into the fitting hole 20*c* of the impeller 20. Therefore, when the rotor 76 rotates, the impeller 20 will also rotate in conjunction. A thrust bearing 33 which bears the thrust load of the rotor 76 is disposed between the lower end of the shaft 78 and the pump body 16.

Figure 4:
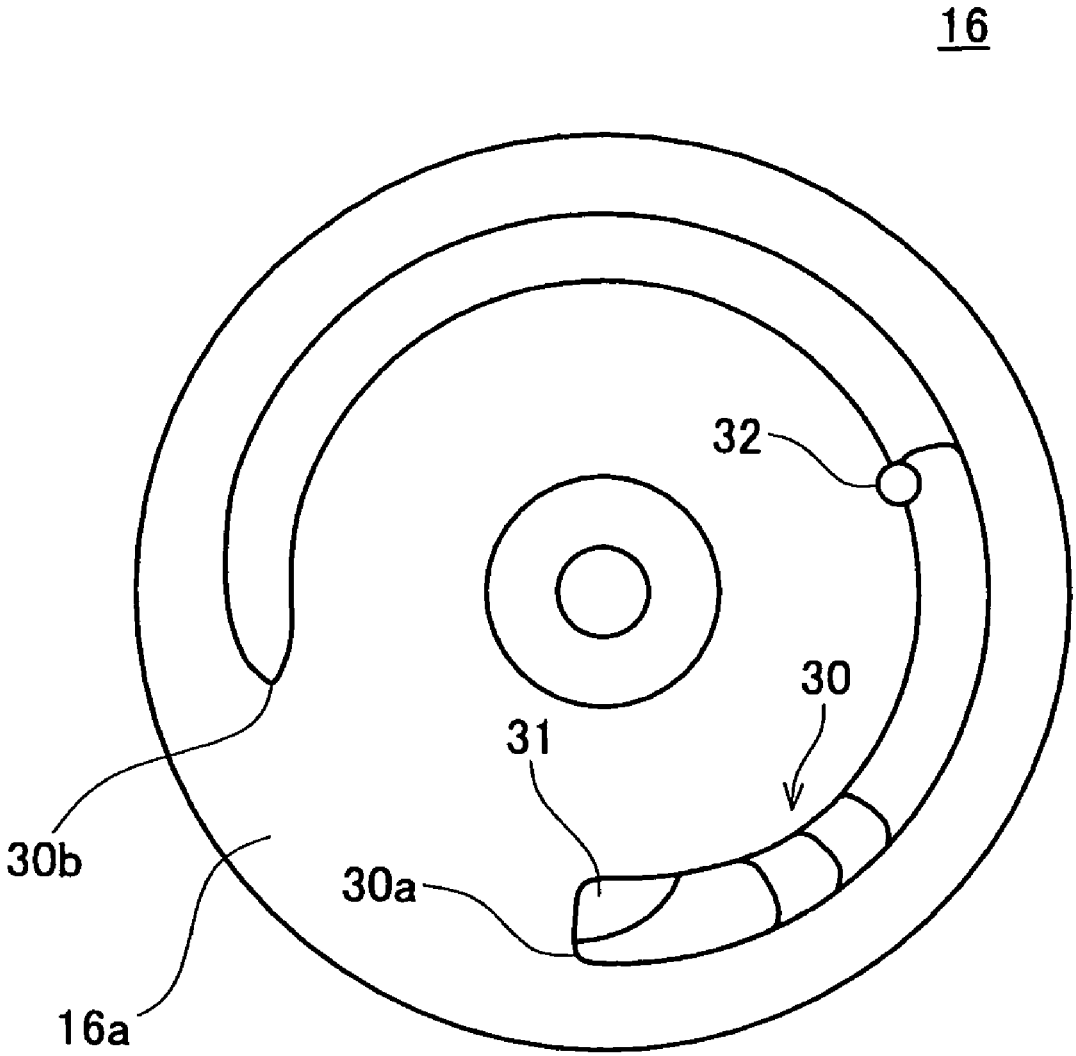
FIG. 4 shows a view of a pump body viewed from the inner side of the casing.

As shown in FIG. 4, a groove 30 is formed in an upper face 16*a* of the pump body 16. The groove 30 is formed in an area facing the group of concavities 21*a* in the lower face of the impeller 20. The groove extends continuously in the direction of rotation of the impeller 20 from an upstream end 30*a* to a downstream end 30*b*.

Figure 6:
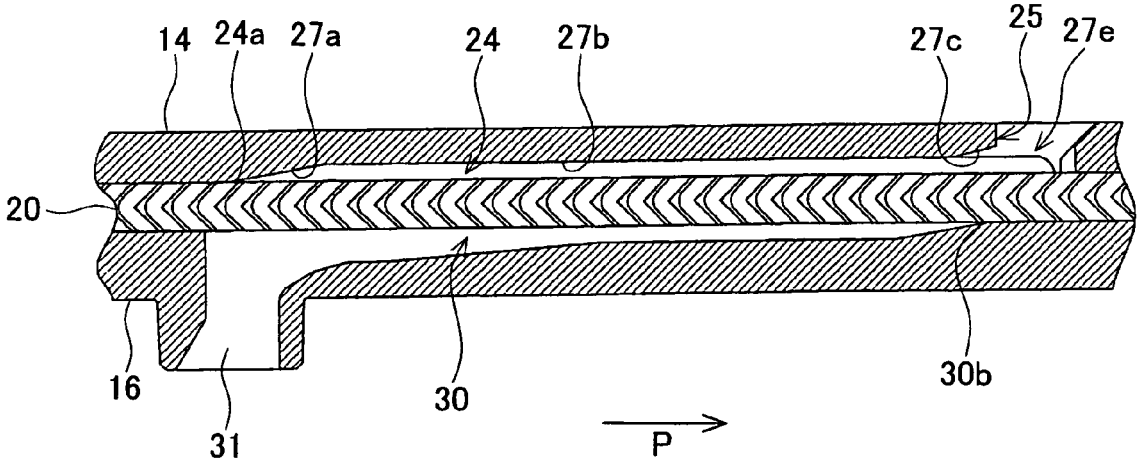
FIG. 6 shows a cross-sectional view along line VI-VI of FIG. 5.

A vapor jet 32 which penetrates vertically (i.e.., vertical direction in FIG. 1) through the pump body 16 is formed at an inner side of the groove 30. The vapor generated when pressure is reduced as the fuel is taken into the groove 30 is discharged to the exterior of the casing 18 via the vapor jet 32. The groove 30 is formed with a substantially consistent depth from the vapor jet 32 to the downstream end 30*b* (as shown in FIG. 6).

The groove 30 gradually deepens from the vapor jet 32 toward the upstream side. A intake hole is formed in the pump body. The groove 30 is connected to the intake hole 31 in the region close to the upstream end 30*a*. As shown in FIG. 1, the intake hole 31 extends from the groove 30 to the lower surface of the pump body 16. The intake hole 31 connects the groove 30 and the outside of the casing 18.

Figure 5:
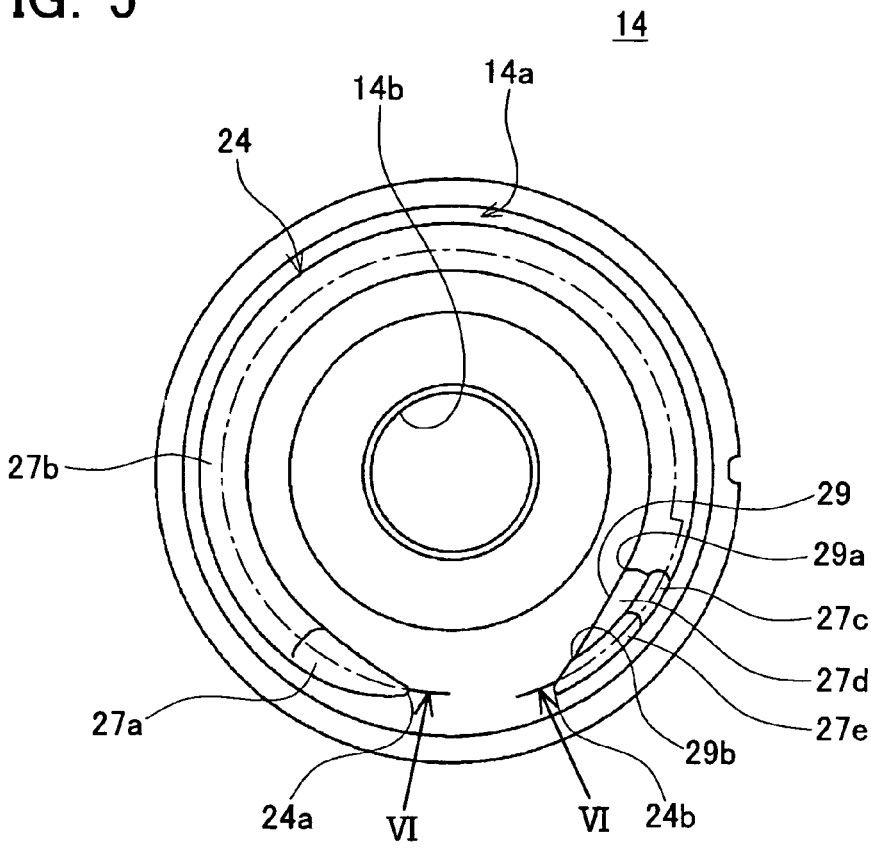
FIG. 5 shows a view of a pump cover viewed from the inner side of the casing.

As shown in FIG. 5, a groove 24 is formed in a lower face of the recess 14*a* of the pump cover 14. The groove 24 is formed in an area facing the group of concavities 20*a* of the upper face of the impeller 20. The groove 24 extends continuously in the direction of rotation of the impeller 20 from an upstream end 24*a* to a downstream end 24*b*.

The groove 24 is connected to a discharge hole 25 in the region around the downstream end 24*b*. The discharge hole 25 extends from the groove 24 to the upper face of the pump cover 14. The discharge hole 25 connects the groove 24 and the outside of the casing 18.

The groove 24 comprises upstream portion 27*a*, middle portion 27*b*, a first escape groove 27*c*, a second escape groove 27*d*, and an opening portion 27*e*. The depth of the groove 24 gradually increases from the upstream end 24*a* up to the upstream portion 27*a*, and exhibits a substantially constant groove depth in a middle portion 27*b* extending from the upstream portion 27*a* to the escape groove 27*c*, 27*d* (refer to FIG. 6). The depth of the middle portion 27*a* of the groove 24 is substantially the same as the groove depth of the groove 30 (i.e.., groove depth between the vapor jet 32 and the downstream end 30*b*). The escape groove 27*c*, 27*d* gradually grows deeper as it approaches the discharge hole 25. The escape groove 27*c*, 27*d* communicates with the discharge hole 25 via the opening portion 27*e*.

In the second escape groove 27*d* (i.e.., the region of the inner perimeter around the downstream end of the groove 24), an inner peripheral edge 29 swerves outwards as it extends in the downstream direction (i.e.., the inner peripheral edge 29 angles towards the outer side of the pump cover 14 as it extends in the downstream direction). Specifically, the upstream end 29*a* of the inner peripheral edge 29 is located at a position corresponding to the inner peripheral edge of the concavities 20*a* of the impeller 20, while a downstream end 29*b* of the inner peripheral edge 29 is located at a position corresponding to a substantially central position, in the radial direction, of the concavities 20*a* on the upper face of the impeller 20. Therefore, the width of the groove 24 tapers off gradually outwards in the second escape groove 27*d*.

In the first escape groove 27*c* (i.e.., the region of the outer perimeter of the groove 24), the groove depth increases in the downstream direction. The inner boundary line of the first escape groove 27*c* corresponds to a substantially central position, in the radial direction, of the concavities 20*a* of the impeller 20, while the outer boundary line corresponds to the outer peripheral edge of the concavities 20*a* of the impeller 20.

The opening portion 27*e* directly communicates with the discharge hole 25. As shown in FIG. 5, the upstream side of the opening portion 27*e* (discharge hole 25) is shaped as an arc extending in the rotation direction of the impeller 20, from a position corresponding to a substantially central position, in the radial direction, of the concavities 20*a* of the impeller 20, to a position corresponding to the outer peripheral edge of the concavities 20*a* of the impeller 20. The downstream end of the opening portion 27*e* is shaped so that the width thereof tapers off gradually in the downstream direction, from the inner perimeter towards the outer perimeter. The downstream end of the opening portion 27*e*, also, extends in the rotation direction of the impeller 20 beyond the downstream end 29*b* of the inner peripheral edge 29 of the second escape groove 27*d*, up to the downstream end 24*b* of the groove 24.

As shown in FIG. 6, the discharge hole 25 is formed more to the side of the rotation direction of the impeller 20 than the upstream end of the opening portion 27*e* and slanting towards the rotation direction of the impeller 20. The downstream end 30*b* of the groove 30 is positioned more to the upstream side than the opening portion 27*e* of the groove 24.

When the impeller 20 rotates, swirl flow is generated between the concavities 21*a* on the lower face of the impeller 20 and the groove 30 of the pump body 16. That is, swirl flow is created in the concavities 21*a* and the groove 30 when the fuel in the concavities 21*a* and the groove 30 flows to the inward side of the concavities 21*a*, from the groove 30, flows then along the concavities 21*a* from the inward side to the outward side through the concavities 21*a*, and then returns from the outward side of the concavities 21*a* to the groove 30. The partition walls 21*b* of the impeller 20 are at an angle with regards to the rotating axle of the impeller 20, so the fuel will flow smoothly from the groove 30 to the concavities 21*a*, and the fuel will be smoothly discharged from the concavities 21*a* to the groove 30.

The fuel inside the casing 18 is pressurized along the groove 30 while revolving as described above. Upon being pressurized along the groove 30, the fuel is drawn in through the intake hole 31 of the pump body 16. The fuel pressurized in the groove 30 mixes with the fuel remaining in the concavities 20*a* on the upper face of the impeller 20. The fuel pressurized in the groove 30 is also pressurized along the groove 24.

Also, as shown in FIG. 6, the depth of the groove 30 decreases gradually in the vicinity of the downstream end 30*b* thereof. Thus, the fuel flowing along the groove 30 hits against the bottom of the groove 30, so that most of the fuel flows from the concavities 21*a* in the lower face of the impeller 20 to the concavities 20*a* in the upper face of the impeller. Herein, the depth of the first escape groove 27*c* increases gradually in the downstream direction, and the downstream end 24*b* of the groove 24 is offset in the rotation direction of the impeller 20. Thus, the fuel flows readily from the concavities 21*a* in the lower face of the impeller 20 towards the concavities 20*a* in the upper face of the impeller 20. This prevents fuel pressure from becoming excessive on the front face of the partition walls 21*b* of the impeller 20 when the partition walls 21*b* pass by the vicinity of the downstream end 30*b* of the groove 30.

Swirl flow is also generated between the concavities 20*a* on the upper side of the impeller 20 and the groove 24. Specifically, swirl flow is created between the concavities 20*a* and the groove 24 when the fuel in the concavities 20*a* and the groove 24 enters the inward side of the concavities 20*a* from the groove 24, flows along the concavities 20*a* from the inward side to the outward side through the concavities 20*a*, and then returns from the outward side of the concavities 20*a* to the groove 24. Herein, the partition walls 20*b* of the impeller 20 are at an angle with regards to the rotating axis of the impeller 20, so fuel will flow smoothly from the groove 24 to the concavities 20*a*, and the fuel will be smoothly discharged from the concavities 20*a* to the groove 24.

In the vicinity of the downstream end 24*b* of the groove 24, the inner peripheral edge 29 of the second escape groove 27*d* on the inner side of the groove 24 swerves gradually outwards while the groove depth of the first escape groove 27*c* on the outer side becomes greater (refer to FIG. 5, 6). As a result, the flow of the fuel flowing along the groove 24 becomes stronger towards the first escape groove 27*c* on the outer side as the width of the groove 24 tapers gradually off. Since the groove depth of the first escape groove 27*c* on the outer side of the groove 24 becomes greater, the fuel colliding against the inner peripheral edge 29 of the groove 24 is pushed outwardly and can flow smoothly towards the first escape groove 27*c* on the outer side. Fuel pressure increases are thereby curbed.

Next, the fuel flowing out from the outer perimeter of the concavities 20*a* of the impeller 20 pass through the opening portion 27*e* of the groove 24 and flow into the discharge hole 25. The opening portion 27*e* is formed at the outside region of the concavities 20*a* of the impeller 20, which allows therefore the fuel flowing out from the concavities 20*a* of the impeller 20 to flow smoothly into the discharge hole 25. The opening portion 27*e*, the downstream end whereof has an width tapering gradually off, extends as an arcuate shape in the rotation direction of the impeller 20, beyond the downstream end 29*b* of the inner peripheral edge 29 of the second escape groove 27*d*. This allows preventing the fuel pressure inside the casing 18 (in particular the fuel on the front face of the partition walls 20*a* of the impeller 20) from becoming excessive.

The fuel flowing out of the discharge hole 25 flows into the housing 72 of the motor portion 70. The fuel which flows into the housing 72 then flows upward through the housing 72 and is discharged from the discharge port 73*a* of the motor cover 73.

Figure 7:
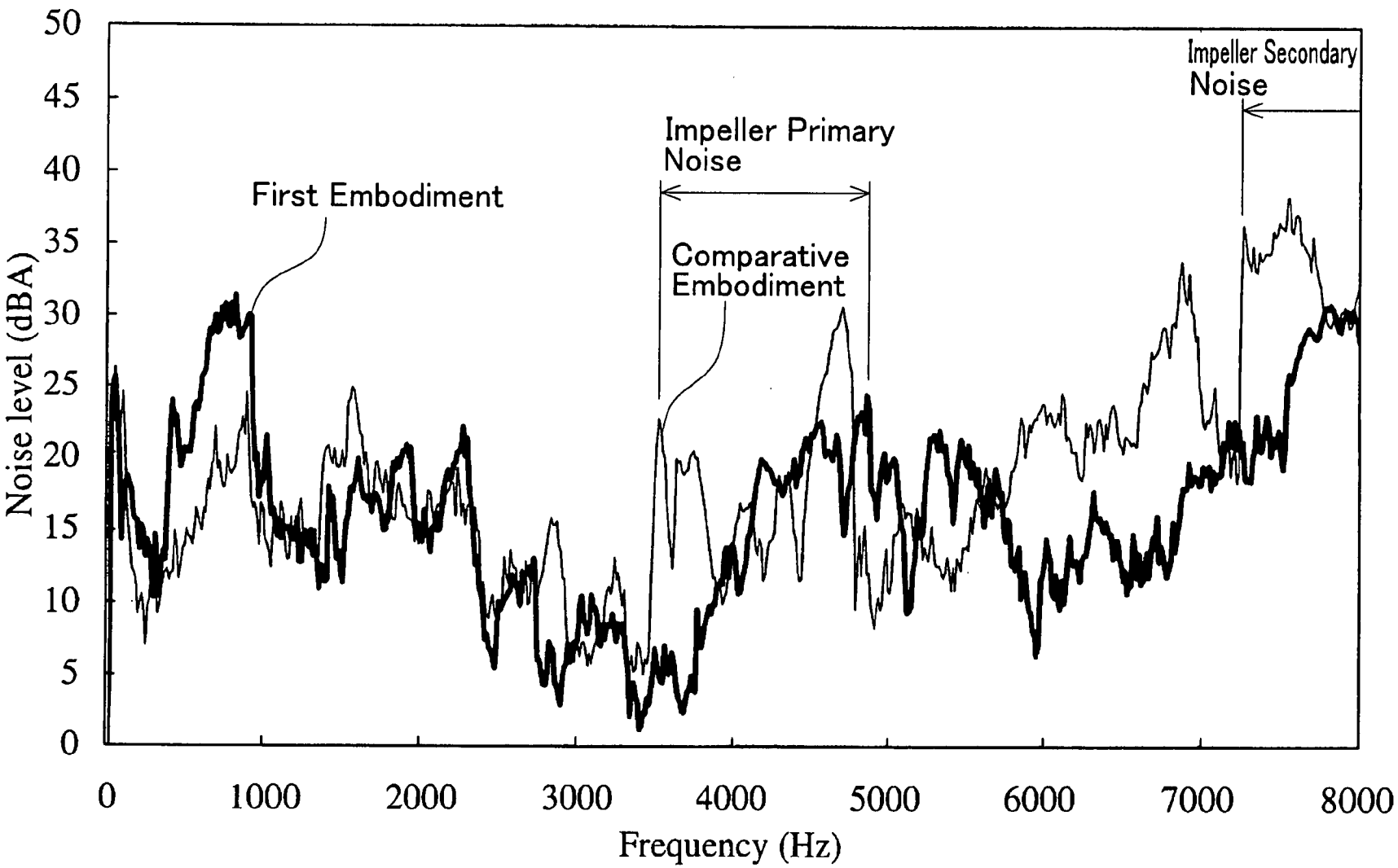
FIG. 7 is a graph collectively illustrating noise measurement results for the fuel pump of the first representative embodiment and noise measurement results for a comparative embodiment illustrated in FIG. 20.

FIG. 7 illustrates the results of measurements carried out for measuring the noise generated upon actual operation of the fuel pump 10 according to the first representative embodiment (denoted as First Embodiment in the figure). For comparison purposes, in the figure are also illustrated noise measurement results for the fuel pump noise using the pump cover 514 depicted in FIG. 20 (denoted as Comparative Embodiment in the figure). In the fuel pump of the comparative embodiment of FIG. 20, as shown in the figure, the downstream end of an opening portion 527 is located at a position connecting with the outer peripheral edge of the groove 524; also, the opening width of the downstream end of the opening portion 527 does not gradually taper off. As shown in FIG. 7 both the primary noise (frequency 3500 rpm to 4900 rpm) and the secondary noise (frequency from 7300 up) of the impeller can be kept at a lower noise level in the fuel pump 10 according to the first representative embodiment than in the fuel pump of the comparative embodiment.

In the fuel pump 10 of the first representative embodiment, as explained above, the opening portion 27*e* of the groove 24 extends as an arcuate shape in the rotation direction of the impeller 20, while the downstream end thereof extends in the rotation direction of the impeller 20 beyond the connecting position 29*b* of the inner peripheral edge 29 of the second escape groove 27*d* of the groove 24. Also, the width of the downstream end of the opening portion 27*e* is shaped so as to taper gradually off. This dampens, as a result, the rise in fuel pressure when the partition walls 20*b* of the impeller 20 pass by the downstream end 24*b* of the groove 24. Also, the downstream end 30*b* of the groove 30 is provided more to the upstream than the downstream end 24*b* of the groove 24; as a result, this curbs the rise in fuel pressure when the partition walls 21*b* of the impeller 20 pass by downstream end 30*b* of the groove 30, and reduces thereby noise in the impeller 20.

The preferred representative embodiment of the present teachings have been described above, the explanation was given using, as an example, the present teachings is not limited to this type of configuration.

Figure 8:
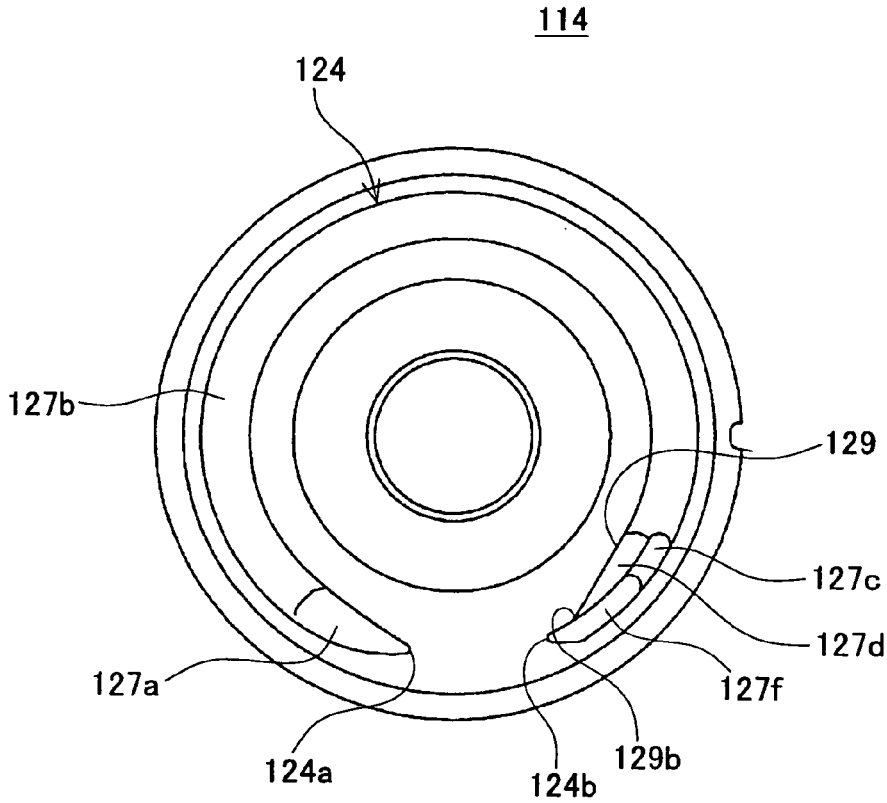
FIG. 8 shows a plan view of a pump cover according to a second representative embodiment, as viewed from the inner side of the casing.
Figure 9:
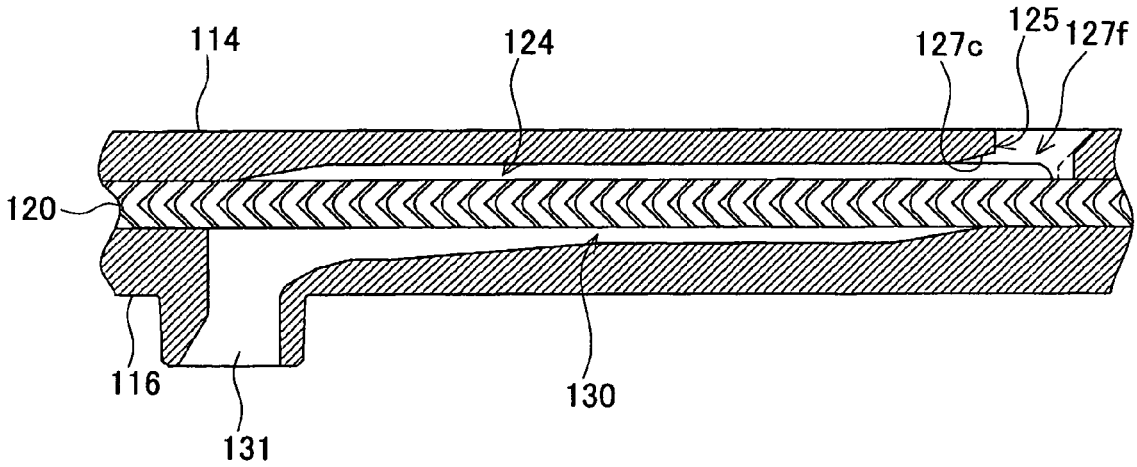
FIG. 9 shows a cross-sectional view of a casing according to the second representative embodiment, cut along a line identical to line VI-VI of FIG. 5.

For example, noise in the fuel pump can be reduced also using a pump cover 114 as illustrated in FIG. 8. In the pump cover 114, an opening portion 127*f* of a groove 124 extends as an arcuate shape in the rotation direction of an impeller 120, while the downstream end thereof extends in the rotation direction of the impeller 120 beyond a downstream end 129*b* of an inner peripheral edge 129*b* of a second escape groove 127*d*. The pump cover 114 differs from that of the fuel pump 10 in the first representative embodiment in that the width of the opening portion 127*e* is shaped so as to gradually taper off from the outer perimeter towards the inner peripheral side. FIG. 9 shows a cross-sectional view of the casing with the pump cover 144 cut along a line identical to line VI-VI of FIG. 5.

Figure 10:
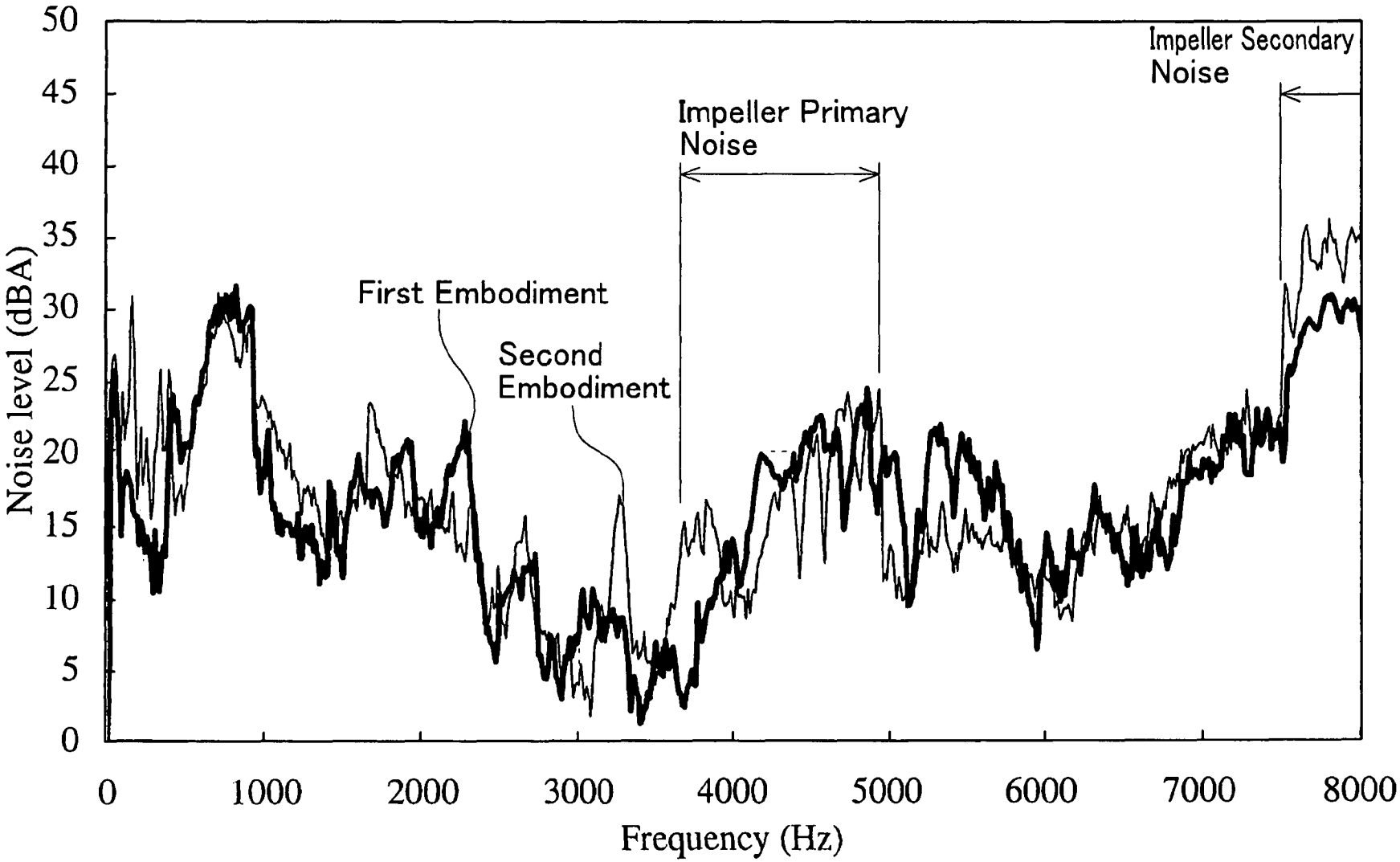
FIG. 10 is a graph collectively illustrating noise measurement results for the fuel pump of the second representative embodiment and noise measurement results for the fuel pump of the first representative embodiment.

FIG. 10 illustrates the noise measurement results for a fuel pump using the pump cover 114 (denoted in the figure as Second Embodiment) and the fuel pump 10 of the first representative embodiment, already explained (denoted in the figure as First Embodiment). As FIG. 10 shows, using the pump cover 114 shown in FIG. 8 allows achieving substantially the same noise level suppression as in the fuel pump 10 of first representative embodiment. In particular, a substantially identical noise suppression can be achieved for the primary noise (frequency 3500 to 4900 rpm).

Figure 11:
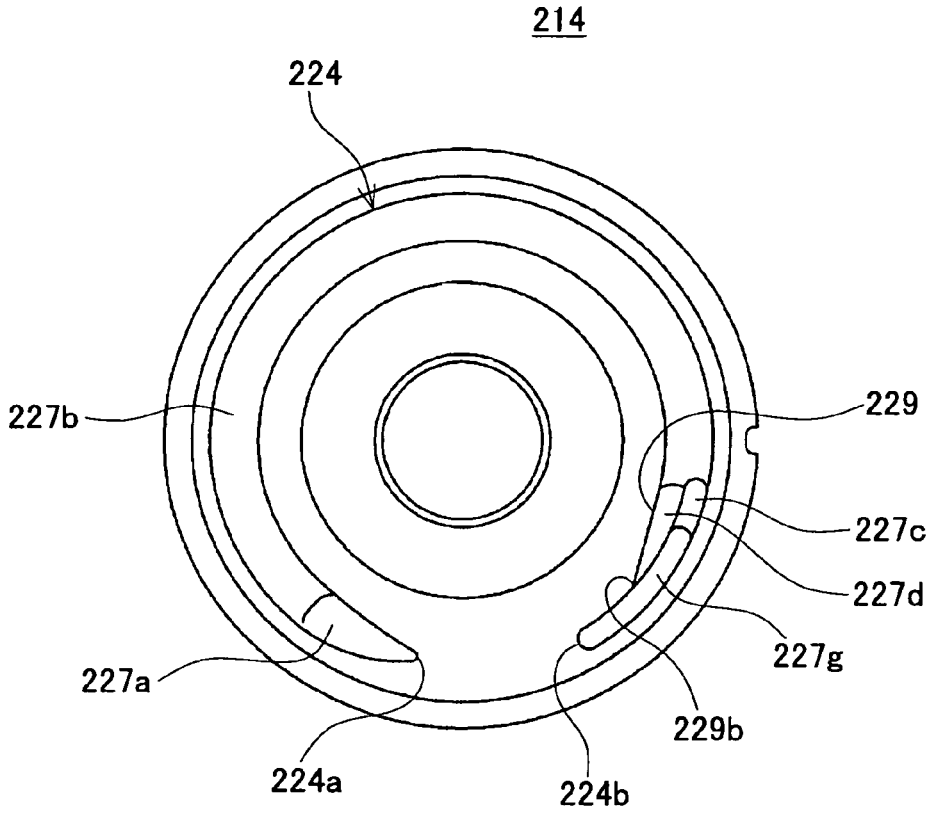
FIG. 11 shows a plan view of a pump cover of a fuel pump according to a third representative embodiment, as viewed from the inner side of the casing.
Figure 12:
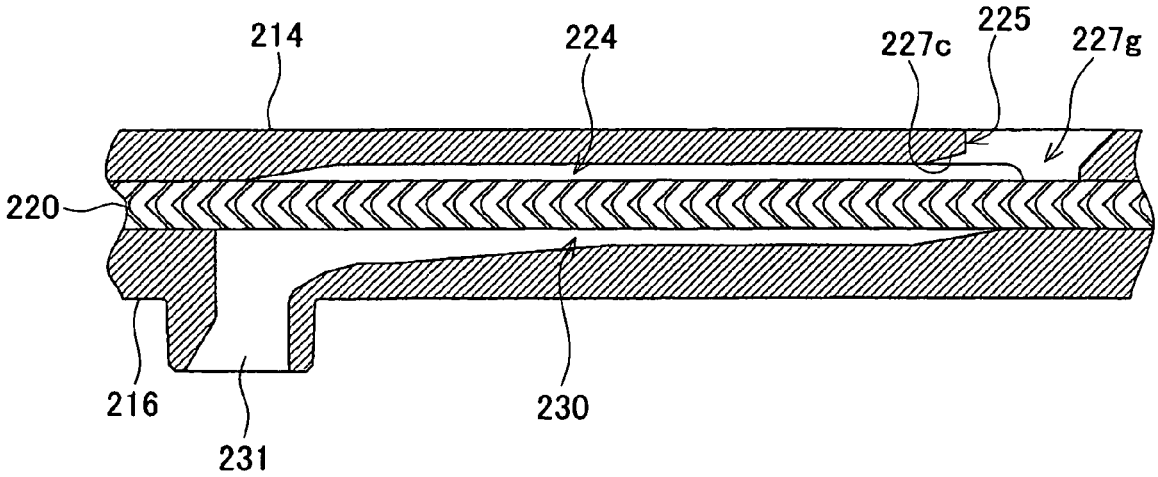
FIG. 12 shows a cross-sectional view of a casing according to the third representative embodiment, cut along a line identical to line VI-VI of FIG. 5.

A pump cover 214 illustrated in FIG. 11 can also be used. As shown in FIG. 11, an opening portion 227*g* of a groove 224 extends in an arcuate shape in the rotation direction of an impeller 220, while the downstream end of the opening portion 227*g* is positioned in the rotation direction of the impeller 220 beyond a downstream end 229*b* of an inner peripheral edge 229 of a second escape groove 227*d*. However, in the pump cover 214, the opening portion 227*e* is longer in the rotation direction of the impeller 220 than was the case in the previous embodiments, while the width of the downstream end of the opening portion 227*e* is not shaped so as to taper gradually off. FIG. 12 shows a cross-sectional view of the casing with the pump cover 214 cut along a line identical to line VI-VI of FIG. 5.

Figure 13:
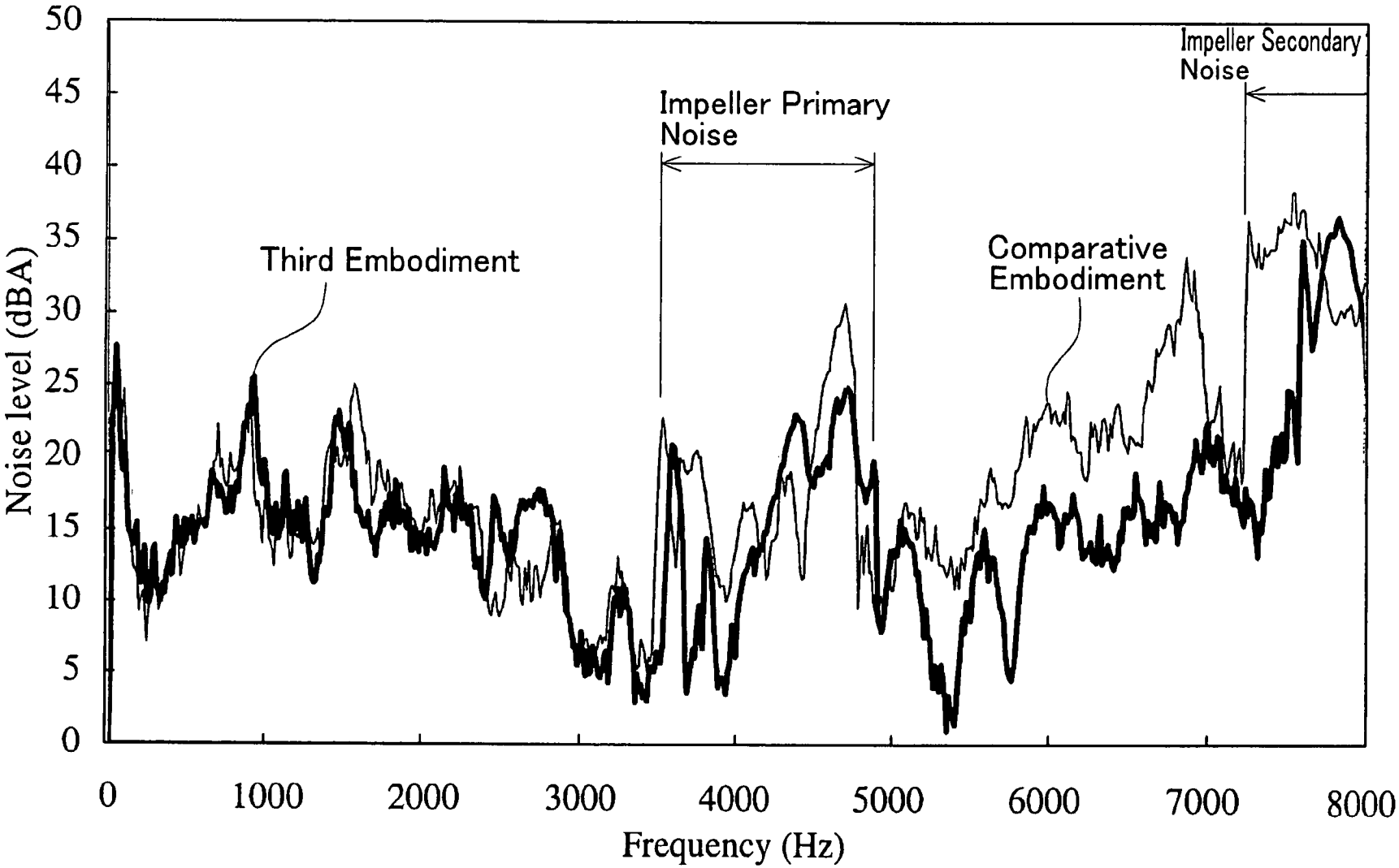
FIG. 13 is a graph collectively illustrating noise measurement results for the fuel pump of the third representative embodiment and noise measurement results for a comparative embodiment illustrated in FIG. 20.
Figure 20:
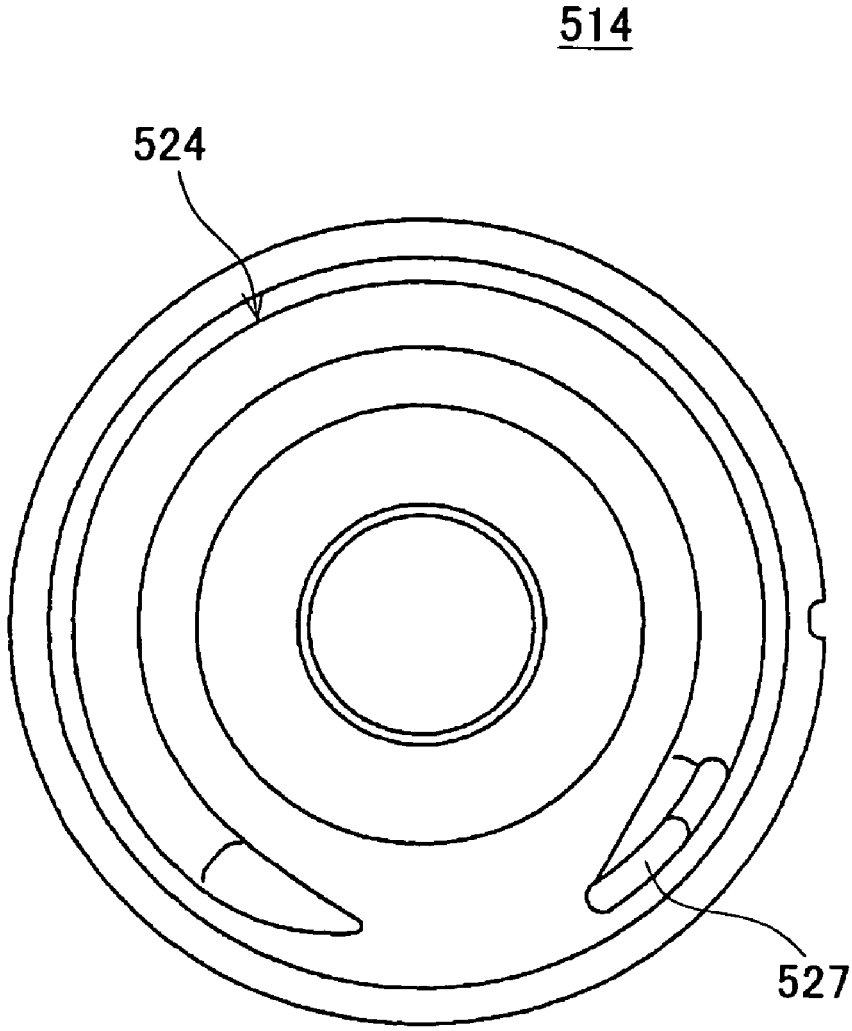
FIG. 20 shows a plan view of a pump cover of the fuel pump according to the comparative embodiment, as viewed from the inner side of the casing.

FIG. 13 illustrates the noise measurement results for a fuel pump using the pump cover 214 (denoted in the figure as Third Embodiment) and using the pump cover 514 depicted in FIG. 20 (denoted in the figure as Comparative Embodiment). As FIG. 13 shows, the noise levels for both the primary noise (frequency 3500 rpm to 4900 rpm) and the secondary noise (frequency from 7300 rpm upwards) of the impeller can be kept lower when using the pump cover 214 than in the fuel pump of the comparative embodiment. A dramatic noise reduction effect was observed in particular for the primary noise (around a frequency of about 4700 rpm).

Figure 14:
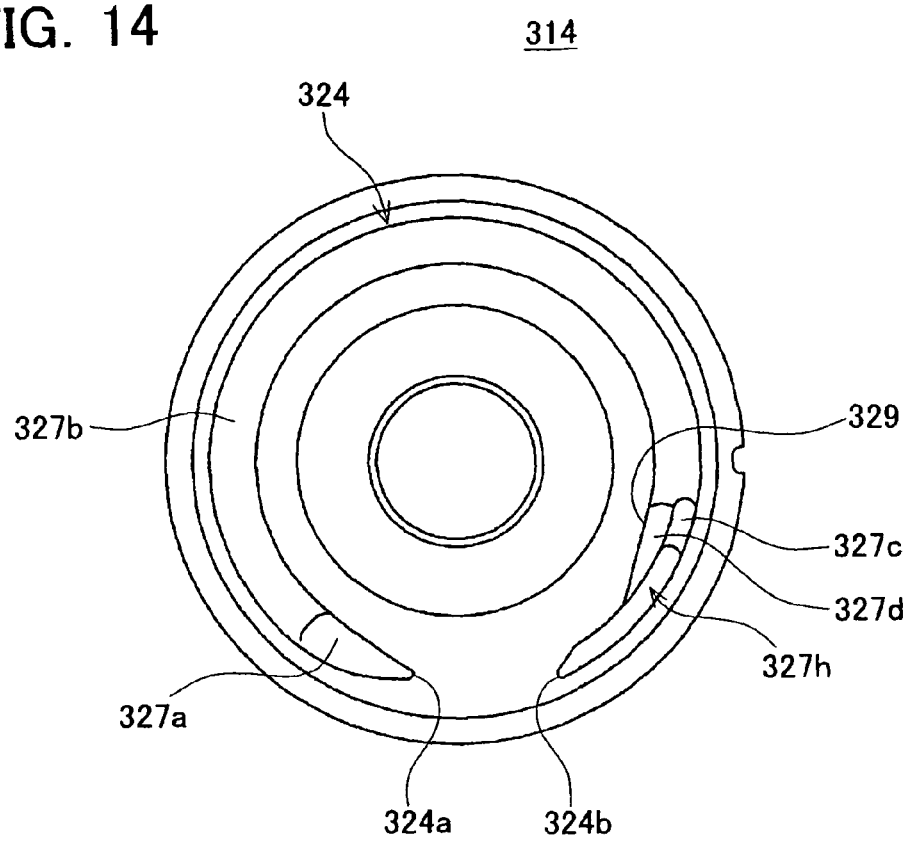
FIG. 14 shows a plan view of a pump cover of a fuel pump according to a fourth representative embodiment, as viewed from the inner side of the casing.
Figure 15:
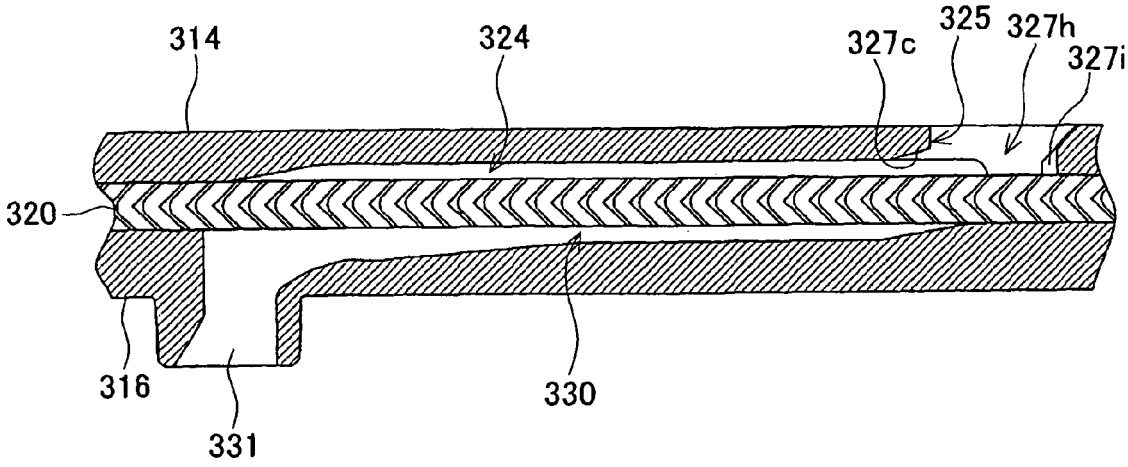
FIG. 15 shows a cross-sectional view of a casing according to the fourth representative embodiment, cut along a line identical to line VI-VI of FIG. 5.
Figure 17:
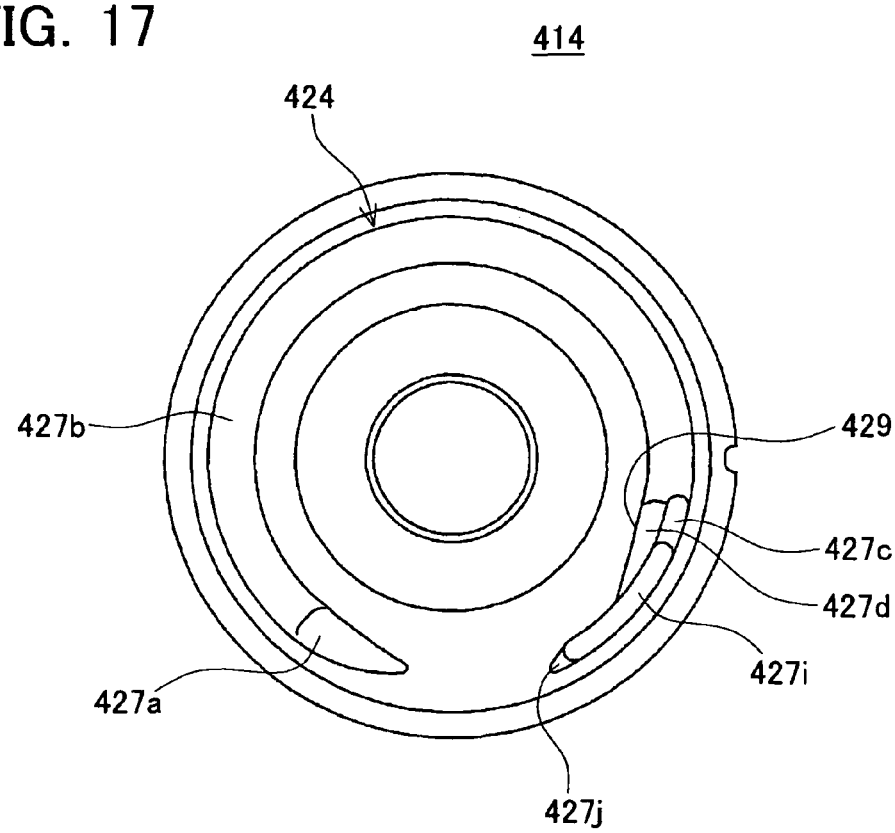
FIG. 17 shows a plan view of a pump cover of a fuel pump according to a fifth representative embodiment, as viewed from the inner side of the casing.
Figure 18:
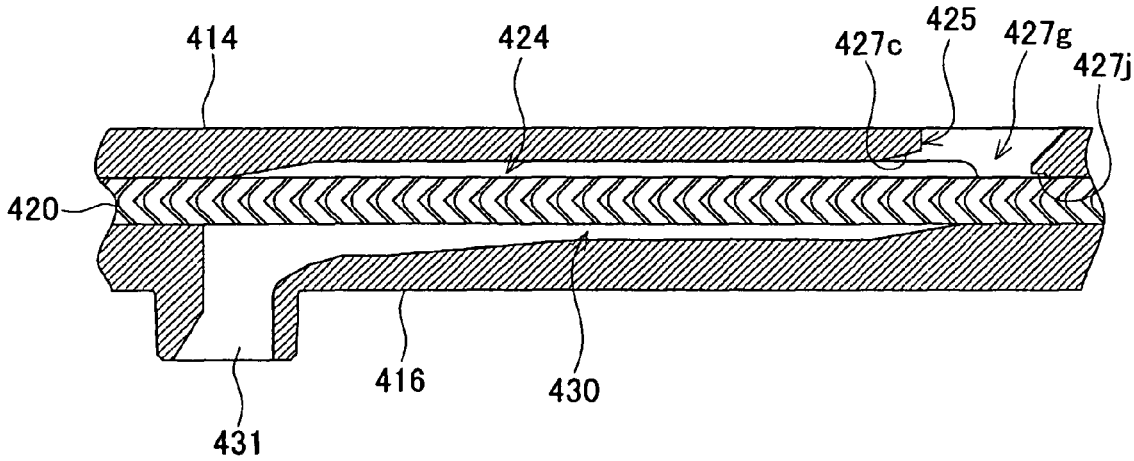
FIG. 18 shows a cross-sectional view of a casing according to the fifth representative embodiment, cut along a line identical to line VI-VI of FIG. 5.

In the embodiment illustrated in FIG. 11, the width of the downstream end of the opening portion 227*g* does not taper off gradually; in FIGS. 14, 17, the width of the downstream end of opening portion 327*h* (427*i*) of a groove 324 (424) may be designed so as to taper off gradually from the inner perimeter towards the outer peripheral side.

Figure 16:
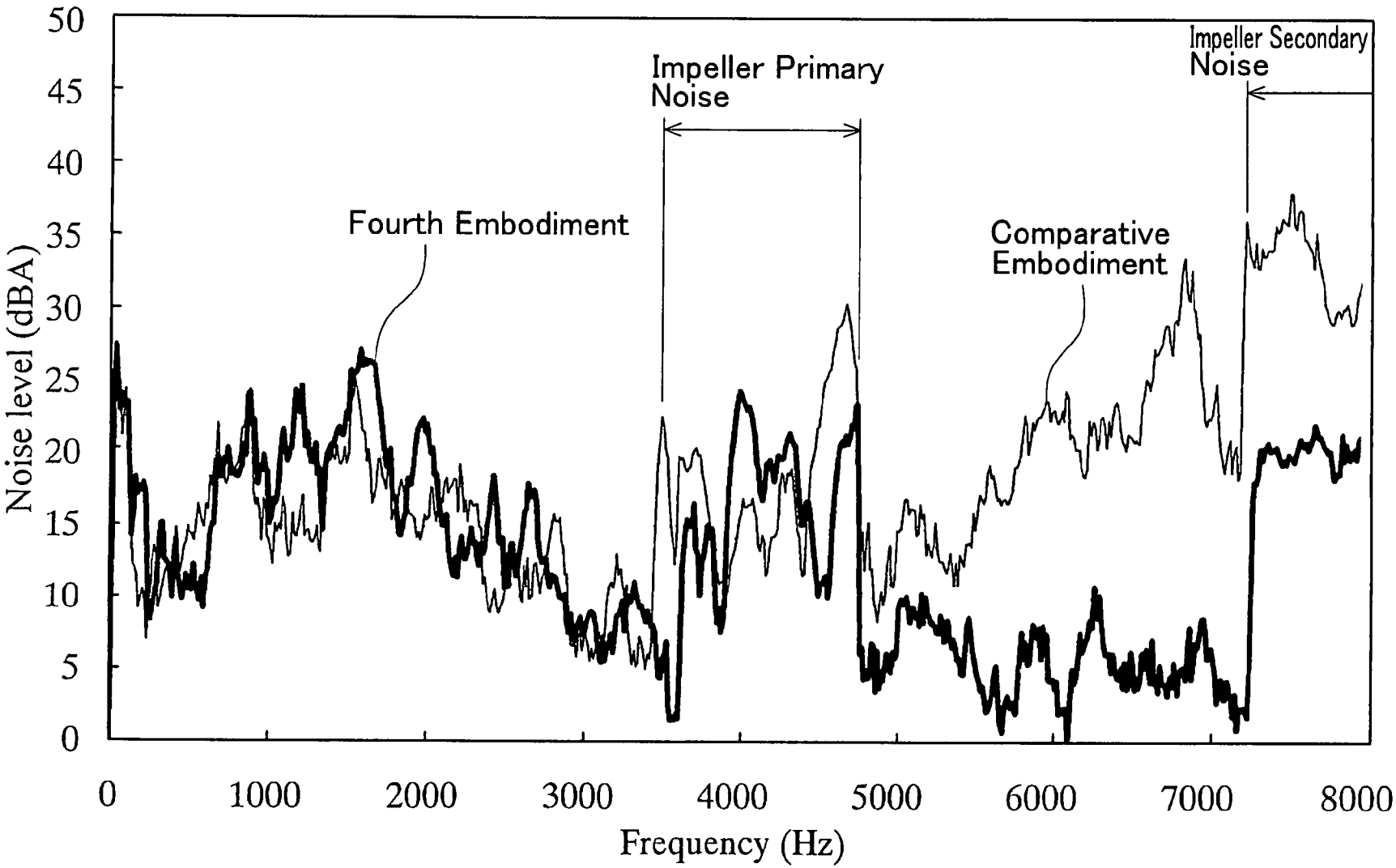
FIG. 16 is a graph collectively illustrating noise measurement results for the fuel pump of the fourth representative embodiment and noise measurement results for a comparative embodiment illustrated in FIG. 20.

FIG. 16 illustrates the noise measurement results when using the pump cover 314 illustrated in FIG. 14 (denoted in the figure as Forth Embodiment) and using the pump cover 514 depicted in FIG. 20 (denoted in the figure as Comparative Embodiment). As FIG. 16 shows, both the primary noise (frequency 3500 rpm to 4900 rpm) and the secondary noise (frequency from 7300 rpm upwards) of the impeller can be kept to an extremely low noise level when using the pump cover 314, as compared with the comparative embodiment. An extremely effective noise reduction can be achieved, therefore, by lengthening the dimensions of the opening portion 27*g* of the groove 24 in the circumferential direction of the impeller, and by forming the width of the downstream end thereof so as to taper off gradually.

In the embodiment illustrated in FIG. 14, an opening portion 327*h* is formed up to the downstream end 324*b* of a groove 324; however, as in the embodiment illustrated in FIG. 17, a buffering groove 427*j* may be formed at the downstream end of an opening portion 427*i* without the width of the opening portion 427*i* tapering off gradually. As illustrated in FIG. 17, the width of the buffering groove 427*j* tapers off gradually from the inner perimeter towards the outer peripheral side. The combined shape of the opening portion 427*i* and the buffering groove 427*j* is equivalent to the shape of the opening portion 327*h* illustrated in FIG. 14.

Figure 19:
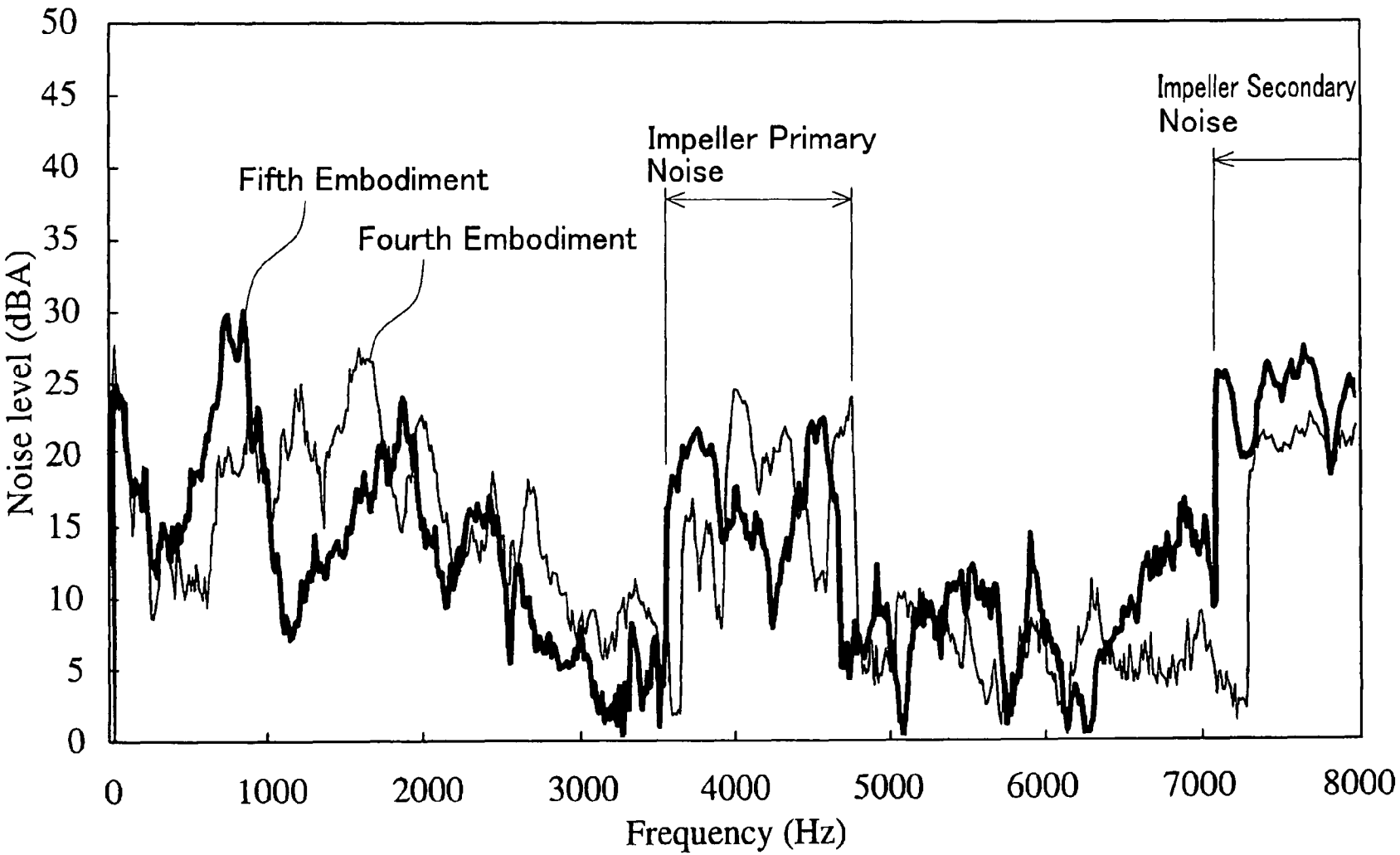
FIG. 19 is a graph collectively illustrating noise measurement results for the fuel pump of the fifth representative embodiment and noise measurement results for the fuel pump of the fourth representative embodiment.

FIG. 19 illustrates the noise measurement results when using the pump cover 414 illustrated in FIG. 17 (denoted in the figure as Fifth Embodiment) and the noise measurement results when using the pump cover 314 illustrated in FIG. 14 (denoted in the figure as Forth Embodiment). As FIG. 19 shows, using the pump cover 414 illustrated in FIG. 17 affords substantially the same noise reduction effect as using the pump cover 314 illustrated in FIG. 14.

Finally, although the preferred representative embodiments have been described in detail, the present embodiments are for illustrative purpose only and not restrictive. It is to be understood that various changes and modifications may be made without departing from the spirit or scope of the appended claims. In addition, the additional features and aspects disclosed herein also may be utilized singularly or in combination with the above aspects and features.

The invention claimed is:

1. A fuel pump comprising a casing and a impeller rotating within the casing, wherein a group of concavities is formed in an upper or a lower face of the impeller, and concavities forming the group are repeated in a circumferential direction of the impeller, a groove communicating with a discharge hole is formed in a inner face of the casing, the groove extending continuously in a direction of rotation of the impeller in an area facing the group of concavities of the impeller, the groove having an opening portion that directly communicates with the discharge hole, the opening portion is shaped so as to extend in an arcuate shape in the rotation direction of the impeller from its upstream end to its downstream end, the opening portion being disposed from its upstream end to its downstream end within an area extending from a position corresponding to substantially the central position of the concavities of the impeller, in the radial direction thereof, to a position corresponding to substantially the outer peripheral edge of the concavities of the impeller, and not being disposed from its upstream end to its downstream end, within an area extending from a position corresponding to substantially an inner peripheral edge of the concavities of the impeller, in the radial direction thereof, to the position corresponding to substantially the central position of the concavities of the impeller, the inner peripheral edge of the groove, on the side communicating with the discharge hole, slants in the downstream end from a position corresponding to substantially the inner peripheral edge of the concavities of the impeller towards a position corresponding to substantially the central position of the concavities of the impeller, in the radial direction thereof, to connect with the opening portion, and the opening portion is formed so as to extend in an arcuate shape in the rotation direction of the impeller towards the downstream side past the position where the inner peripheral edge connects therewith.

2. A fuel pump as in claim 1, wherein a part of the opening portion extending in the arcuate shape in the rotation direction of the impeller towards the downstream side past the position where the inner peripheral edge connects with the opening portion has a width substantially identical to a span extending from a position corresponding to substantially the central position of the concavities of the impeller, in the radial direction thereof, to a position corresponding to substantially the outer peripheral edge of the concavities of the impeller.

3. A fuel pump as in claim 2, wherein the width of the opening portion in the downstream end side tapers off gradually towards the downstream side.

4. A fuel pump as in claim 3, wherein the width of the opening portion in the downstream end tapers off gradually from the inner perimeter of the opening portion towards the outer perimeter thereof, or from the outer perimeter of the opening portion towards the inner perimeter thereof, or from both the inner and outer perimeter of the opening portion towards the middle thereof.

5. A fuel pump as in claim 2, wherein a buffering groove is further formed at the downstream end of the opening portion of the groove, and wherein the buffering groove has a width that tapers gradually off towards the downstream side.

6. A fuel pump as in claim 1, wherein the discharge hole is formed so as to extend in the rotation direction of the impeller beyond the upstream end of the opening portion of the groove.

7. A fuel pump as in claim 6, wherein the discharge hole is formed slanting in the rotation direction of the impeller from the opening portion of the groove.

* * * * *